United States Patent [19]

Cucuiat et al.

[11] 4,171,349

[45] Oct. 16, 1979

[54] DESULFURIZATION PROCESS AND INSTALLATION FOR HYDROCARBON RESERVOIR FLUIDS PRODUCED BY WELLS

[75] Inventors: Iulius M. Cucuiat; Vasile V. Popp, both of Cîmpina, Romania

[73] Assignee: Institutul de Cercetari Si Proiectari Pentru Petrol Si Gaze, Cimpina, Romania

[21] Appl. No.: 896,394

[22] Filed: Apr. 14, 1978

[30] Foreign Application Priority Data

Aug. 12, 1977 [RO] Romania ..... 91347

[51] Int. Cl.[2] ..... C01B 17/04

[52] U.S. Cl. ..... 423/574 L; 166/267; 208/242; 423/575

[58] Field of Search ..... 208/242, 222, 223, 293; 166/265, 266, 267; 423/574 L, 574 R

[56] References Cited

U.S. PATENT DOCUMENTS

| | | | |
|---|---|---|---|
| 1,674,676 | 6/1928 | Hess | 208/293 |
| 1,710,200 | 4/1929 | Black et al. | 208/293 |
| 1,993,140 | 3/1935 | Hamilton et al. | 208/242 |
| 2,043,084 | 6/1936 | Ward et al. | 423/574 L |
| 3,111,983 | 11/1963 | Frank | 166/266 |

*Primary Examiner*—George Crasanakis
*Attorney, Agent, or Firm*—Karl F. Ross

[57] ABSTRACT

Hydrogen sulfide is removed from a three-phase mixture of crude oil, natural gas, and water as it issues as a stream from an oil well by first adding liquid sulfur dioxide to the stream without substantially changing its temperature or pressure and then turbulencing the stream to react most of the hydrogen sulfide therein with the sulfur dioxide. Water containing an additive capable of forming a salt with the remaining trace hydrogen sulfide is then added to the stream and then the desulfurized natural gas is separated out of the stream. Hot and sulfur-free crude oil is then injected into the stream to melt the sulfur therein and the stream is then gravitationally separated into sulfur, water, and pure sulfur-free crude oil, some of the last of which is heated and reintroduced into the stream upstream to heat same and melt the sulfur therein.

6 Claims, 1 Drawing Figure

Figure 1:
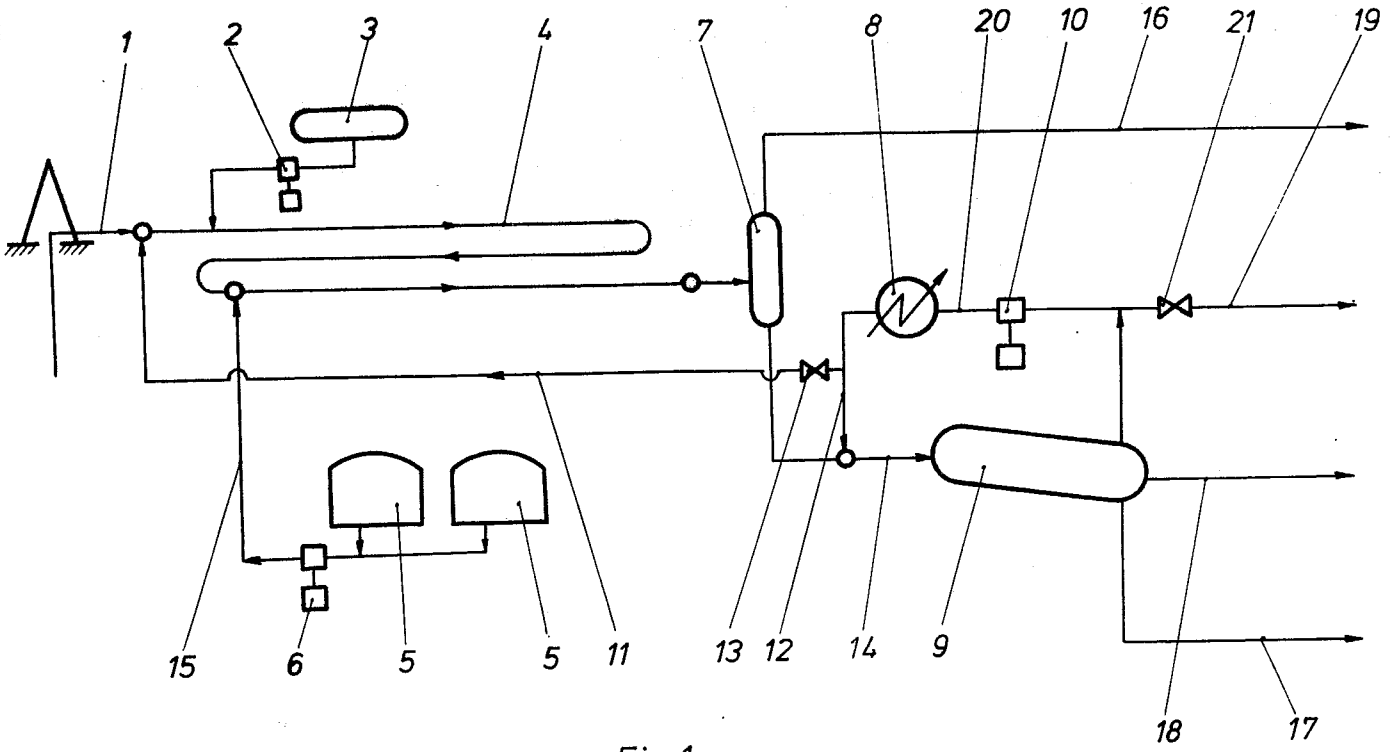

DESULFURIZATION PROCESS AND INSTALLATION FOR HYDROCARBON RESERVOIR FLUIDS PRODUCED BY WELLS

FIELD OF THE INVENTION

The invention relates to a desulfurization process and installation for hydrocarbon reservoir fluids produced by wells.

BACKGROUND OF THE INVENTION

Processes for the desulfurization of gas (natural gas, $CO_2$ gas mixtures, etc.), crude oil and water produced from hydrocarbon reservoirs after separating these phases have been long known. The gas desulfurization processes usually apply absorption, with or without chemical reaction, or adsorption followed by sulfur recovery from $H_2S$ set free during solvent or adsorbent regeneration, by the Claus process, or direct conversion by which the $H_2S$ is retained from the gas and simultaneously oxidized to sulfur by an oxidizing agent dissolved in an organic solvent.

For the desulfurization of crude oils hydrogenation processes and conversion of sulfur compounds to $H_2S$ gas are used, the $H_2S$ gas being then removed by one of the above processes.

Water desulfurization is achieved using alkaline solutions to neutralize $H_2S$, or solutions containing ions that retain $H_2S$ as insoluble (precipitated) sulphides.

The drawbacks of these processes are such that they are applied after phase separation (gas, crude and water) causing considerable corrosion of pipelines and of phase separators. They cannot be applied to "rich" gas (containing more than 20 g/Nm$^3$ of propane plus) and can be only selectively applied for certain $H_2S$ concentration ranges, in addition large size facilities made of non-corrosive materials are required with high energy consumption and generally expensive chemicals.

The installations used by the above-mentioned desulfurization processes involve either absorption columns for $H_2S$ and/or other sulfur compounds of the gas, or hydrogenation columns for crude distillates (light fractions), previously vaporized, with the thus formed $H_2S$ being removed into an absorption column or treaters, in the case of water desulfurization, where alkaline or cations containing solutions react with $H_2S$, resulting in a sludge, that is removed by settling.

The disadvantages of these installations are such that for high gas rates relatively large size absorption columns are required and the materials they are made from are expensive because of the highly corrosive environment.

SUMMARY OF THE INVENTION

The process according to the present invention eliminates the above drawbacks in that for the simultaneous desulfurization of gas and/or crude and/or condensate produced together with water from hydrocarbon reservoirs, and to avoid at the same time corrosion by these fluids of pipelines and phase separators and ensure desulfurization of gas, regardless of the $H_2S$ and propane plus content, comprises a plurality of steps. Thus, during the first step, the multiphase mixture of liquids coming from one or several wells, after being brought to turbulent flow conditions in the flow-line of the well or wells, is contacted in said flow-line with $SO_2$ fed at the pressure and temperature of the fluids, the $SO_2$ amount depending upon the $H_2S$ content of the fluid mixture, and allowing a certain flowing time for the fluids so that almost all of the existing $H_2S$ can react with the fed $SO_2$. Meanwhile during a second step, formation water, containing insoluble sulphides forming ions (precipitates) in the presence of $H_2S$, or alkaline solutions that neutralize $H_2S$ are introduced into the fluid mixture containing $H_2S$ traces. Then, during a third step, the desulfurized gas is separated from the water and the crude with sulfur sludge, resulting from the $H_2S$ reaction with $SO_2$, and with possible insoluble sulphides. Thereafter, during a fourth step, the water and the crude together with the sulfur sludge and the dispersed sulphides are indirectly heated using desulfured, hot crude, to about 120° C. At this temperature the sulfur will melt and separate from the water and crude together with the sulphides. The sulfur is then used as such or to produce $SO_2$. The desulfured water is led to disposal means or injected into the formation. During a fifth step, part of the desulfured crude is led to storage tanks and part is heated and mixed with the water, crude and sulfur sludge separated from the desulfured gas. Thereafter part of the heated crude is injected, continuously or discontinuously, upstream of the $SO_2$ injection point into the flow-line to avoid deposition of sulfur suspension.

The installation used to apply the process according to the invention comprises a thermally, insulated reaction line, the length of which depends upon the reaction time, about 1 min., between the $H_2S$ contained by the fluids and the $SO_2$ fed with a pump from a tank into said line. Said line is linked at one end with the flow-line conveying the fluids—crude, water and gas—produced by wells from hydrocarbon reservoirs, and at the other end with a gas-liquid separator by means of another line. The $H_2S$ free gas is led from said separator to a processing plant or to consumers and the crude oil, water and sulfur resulting from the reaction between $H_2S$ and $SO_2$ are led to a horizontal, thermally insulated separator. The separated sulfur is used as such or to produce $SO_2$. The separated water can be injected back into the formation and the separated crude, cleaned to pipeline specifications, is led in part to a processing plant and in part is pumped into a heater from which, one part is injected into a reaction line, before the fluid therein is contacted with the fed $SO_2$, in order to avoid sulfur deposition in the reaction line. The other part is injected into a line connecting the gas-liquid separator to the horizontal separator, where crude, water and sulfur are heated to about 120° C. In order to eliminate the non-reacted $H_2S$ traces, one or several tanks are provided to supply formation water containing cations that precipitate $H_2S$, and/or alkaline solutions, said formation water or solutions being injected into the reaction line near the gas-liquid separator.

To illustrate the application of the process and installation described herein, three examples are presented in connection with the accompanying drawing.

EXAMPLE 1

According to this example of the present invention, for desulfurizing a mixture of gas and/or crude oil and/or condensate produced from one or several wells together with water from an oil reservoir by natural flow. During a first step said mixture, for which turbulent flow conditions are provided for in a line 1, is contacted with $SO_2$, fed continuously with a pump 2 from a tank 3 containing liquid $SO_2$, into the upstream end of a line 4. The liquid $SO_2$ is pumped at the pressure and temperature of line 4 (regardless of the mixture pressure and temperature as increased pressure and temperature step up the reaction between $H_2S$ and $SO_2$), the amount of fed $SO_2$ depending upon the total $H_2S$ concentration of the fluids, as required for stoichiometrical reaction with $H_2S$. After contacting the $SO_2$ in turbulent flow a flowing time of at least 30 sec. is allowed for the mixture to react with the whole amount of $SO_2$, leaving thus trace $H_2S$, i.e. less than 100 ppm volume. During a second step the fluid mixture containing suspended sulfur, as resulted from the $H_2S$-$SO_2$ reaction, and trace $H_2S$ is contacted with formation water pumped from tank 5 with pump 6, (for instance in an amount of 1 $m^3$ water/1000 $Nm^3$ of gas). Said water contains ions that form insoluble sulphides with $H_2S$, or said fluid mixture contacts alkaline solutions that neutralize the $H_2S$ traces. In a third step, in a conventional separator 7, the desulfurized gas separates at the top thereof, and the water, crude oil and sulfur sludge containing possible insoluble sulphides dispersed in the liquid, are removed at the bottom. During a fourth step the water, crude oil and sulfur sludge containing possible insoluble, dispersed sulphides are heated to about 120° C. in contact with clean hot crude oil, coming from heater 8. At this temperature the sulfur will melt and separate by gravity, together with possible insoluble sulphides, from the water and crude oil, into a thermally insulated separator 9. The molten sulfur together with possible insoluble sulphides can be used as such or for producing $SO_2$. The desulfurized water is removed from the separator and injected into the oil reservoir or is led to disposal means. During a fifth step a part of the desulfurized crude oil is led to storage tanks and the balance is heated in the directly fired heater 8 to say about 180° C. By means of pump 10 part of the hot crude oil is led continuously or periodically through pipes 11 and 12 to be injected into line 1 upstream and near the $SO_2$ feeding point, to prevent sulfur deposition in the transportation lines, while by shutting off valve 13 part of the hot crude is led into line 14, through which the fluids separated in separator 7 arrive at the horizontal separator 9.

The formation water or the alkaline solutions from tanks 5 are flowed, by means of pump 6, through the line 15 to the downstream end of line 4, in the neighbourhood of the gas-liquid separator 7.

Pump 2 can be controlled by a $H_2S$ and/or $SO_2$ analyser located on line 4 up stream of its downstream end.

The gas is removed from separator 7 through the line 16, while the sulfur, water and crude oil are removed from separator 9 via lines 17,18,19. A control valve 21 is mounted between line 20, supplying the heater 8, and the line 19.

EXAMPLE 2

This example presents another embodiment of the invention for the desulfurization of the fluids produced from an oil reservoir through pumping wells. For instance, crude oil and/or condensate with water and small gas amounts, in which the process described in Example 1 is used, the only difference being that the fluid mixture is produced at a rate insufficient for achieving turbulent flow in the flow-line, must be pumped through said flow-line at a rate sufficiently high to assure turbulent flow.

EXAMPLE 3

According to this example the invention is applied for the desulfurization of gas produced by gas wells, including high $CO_2$ gas wells, in the manner as described in Example 1, except that in the first step, after the gas is brought to the surface together with water, before contacting them with $SO_2$ crude oil or condensate are injected into the flow-line, for example 1 $m^3$/1000 $Nm^3$ of gas, from a tank of the tank battery, in this way the stabilization of the crude or condensate is also achieved.

The process and installation according to the present invention have the following advantages:

the separate or simultaneous desulphurization of a multi-phase fluid mixture is achieved before phase separation, thus avoiding the corrosion of pipelines and phase separators;

the desulphurization of natural gas containing heavy components, propane +, is possible regardless of their concentration and the $H_2S$ and $CO_2$ content;

it is not necessary to use, for each treated phase, big size facilities made of non-corroding materials, requiring high energy consumption and expensive chemicals;

environment pollution by sulphurous waste gas is eliminated; and simple construction and operation of the means used by the invention are another important advantage.

We claim:

1. A method of removing hydrogen sulfide from a three-phase mixture of crude oil, natural gas, and water as said mixture issues as a stream from an oil well, said method comprising the steps of:

(a) adding sulfur dioxide to said stream without substantially changing the temperature or pressure of said stream and thereafter rendering said stream turbulent to intimately contact said sulfur dioxide with the hydrogen sulfide in said stream, thereby reacting same together and leaving only trace hydrogen sulfide in said stream;

(b) adding water to said stream from step (a) said water containing (1) cations capable of forming insoluble sulphides or (2) an alkaline for neutralizing said trace hydrogen sulfide;

(c) separating the desulfurized natural gas from said stream from step (b);

(d) adding hot and sulfur-free crude oil to the remaining stream from step (c) to heat same to about 120° C. to melt elemental sulfur therein;

(e) gravitationally separating the sulfur and water from said stream from step (d), leaving substantially pure sulfur-free crude oil in said stream; and (f) heating a portion of the pure crude oil of step (e) and adding said hot crude oil in step (d).

2. The method defined in claim 1, further comprising the step of heating another portion of the pure crude oil of step (f) and adding said hot crude oil to said stream from an oil well prior to step (a).

3. The method defined in claim 1 wherein said portion of pure crude oil in step (f) is heated to about 180° C.

4. The method defined in claim 1 wherein said sulfur dioxide of step (a) is added at a pressure and at a temperature respectively generally proportional to the pressure and temperature of said stream.

5. The method defined in claim 1 wherein said water of step (b) contains cations that form insoluble sulfide salts with said hydrogen sulfide.

6. The method defined in claim 1 wherein said water of step (b) contains ions that renders said water alkaline.

* * * * *